US008363514B2

(12) United States Patent
Huang

(10) Patent No.: US 8,363,514 B2
(45) Date of Patent: Jan. 29, 2013

(54) VARIABLE OPERATING VOLTAGE IN MICROMACHINED ULTRASONIC TRANSDUCER

(75) Inventor: Yongli Huang, San Jose, CA (US)

(73) Assignee: Kolo Technologies, Inc., San Jose, CA (US)

( * ) Notice: Subject to any disclaimer, the term of this patent is extended or adjusted under 35 U.S.C. 154(b) by 123 days.

(21) Appl. No.: 12/745,735

(22) PCT Filed: Nov. 26, 2008

(86) PCT No.: PCT/US2008/085025

§ 371 (c)(1),
(2), (4) Date: Jun. 2, 2010

(87) PCT Pub. No.: WO2009/073561

PCT Pub. Date: Jun. 11, 2009

(65) Prior Publication Data

US 2010/0278015 A1 Nov. 4, 2010

Related U.S. Application Data

(60) Provisional application No. 60/992,046, filed on Dec. 3, 2007.

(51) Int. Cl.
*H04R 19/00* (2006.01)

(52) U.S. Cl. ..... 367/181

(58) Field of Classification Search ..... 367/181
See application file for complete search history.

(56) References Cited

U.S. PATENT DOCUMENTS

| | | | | |
|---|---|---|---|---|
| 6,527,723 | B2 * | 3/2003 | Ossmann et al. | 600/459 |
| 6,795,374 | B2 * | 9/2004 | Barnes et al. | 367/138 |
| 2003/0048698 | A1 | 3/2003 | Barnes et al. | |
| 2003/0149363 | A1 | 8/2003 | Dreschel et al. | |
| 2005/0146240 | A1 * | 7/2005 | Smith et al. | 310/309 |
| 2006/0173342 | A1 * | 8/2006 | Panda et al. | 600/459 |
| 2007/0228877 | A1 | 10/2007 | Huang | |
| 2007/0287918 | A1 * | 12/2007 | Huang | 600/459 |
| 2009/0048522 | A1 * | 2/2009 | Huang | 600/459 |

* cited by examiner

*Primary Examiner* — Isam Alsomiri
*Assistant Examiner* — James Hulka
(74) *Attorney, Agent, or Firm* — Lee & Hayes, PLLC

(57) ABSTRACT

A cMUT and a cMUT operation method use an input signal that has two components with different frequency characteristics. The first component has primarily acoustic frequencies within a frequency response band of the cMUT, while the second component has primarily frequencies out of the frequency response band. The bias signal and the second component of the input signal together apply an operation voltage on the cMUT. The operation voltage is variable between operation modes, such as transmission and reception modes. The cMUT allows variable operation voltage by requiring only one AC component. This allows the bias signal to be commonly shared by multiple cMUT elements, and simplifies fabrication. The implementations of the cMUT and the operation method are particularly suitable for ultrasonic harmonic imaging in which the reception mode receives higher harmonic frequencies.

30 Claims, 8 Drawing Sheets

VARIABLE OPERATING VOLTAGE IN MICROMACHINED ULTRASONIC TRANSDUCER

RELATED APPLICATIONS

This application claims priority benefit of U.S. Provisional Patent Application No. 60/992,046 entitled "OPERATION OPTIMIZATION FOR MICROMACHINED ULTRASONIC TRANSDUCERS", filed on Dec. 3, 2007, which application is hereby incorporated by reference in its entirety.

BACKGROUND

Capacitive micromachined ultrasonic transducers (cMUTs) are electrostatic actuators/transducers, which are widely used in various applications. Ultrasonic transducers can operate in a variety of media including liquids, solids and gas. Ultrasonic transducers are commonly used for medical imaging for diagnostics and therapy, biochemical imaging, non-destructive evaluation of materials, sonar, communication, proximity sensors, gas flow measurements, in-situ process monitoring, acoustic microscopy, underwater sensing and imaging, and numerous other practical applications. A typical structure of a cMUT is a parallel plate capacitor with a rigid bottom electrode and a movable top electrode residing on or within a flexible membrane, which is used to transmit/accurate (TX) or receive/detect (RX) an acoustic wave in an adjacent medium. A direct current (DC) bias voltage may be applied between the electrodes to deflect the membrane to an optimum position for cMUT operation, usually with the goal of maximizing sensitivity and bandwidth. During transmission an alternating current (AC) signal is applied to the transducer. The alternating electrostatic force between the top electrode and the bottom electrode actuates the membrane in order to deliver acoustic energy into the medium surrounding the cMUT. During reception an impinging acoustic wave causes the membrane to vibrate, thus altering the capacitance between the two electrodes.

One of the important properties of a cMUT is its operation voltage, which is a voltage signal applied to the cMUT in addition to the AC signal applied to generate acoustic energy. In existing cMUT operation methods, a DC voltage is used to bias the cMUT. A TX input signal applied on the cMUT to generate the acoustic output. In these methods, the operation voltage of the cMUT is determined by the DC bias voltage signal only. The same operation voltage level is used in both transmission and reception operations. However, the optimal operating conditions may be different for a cMUT to work in transmission and reception operations. Therefore, using a constant operation voltage level requires a trade-off in selecting a proper operating level in order to obtain an optimal overall performance. This trade-off places a hurdle in a cMUT performance improvement.

To overcome this problem, variable operation voltages in transmission and reception modes have been suggested. This is accomplished by using different bias voltage levels for the two operation modes. Specifically, an AC bias signal with different bias level for TX and RX operations is used to replace a DC bias signal. This method needs two high voltage AC signals in operation: the TX input signal, which is the same as the one used in the other conventional methods, to generate the acoustic output only; and the AC bias signal to change the operation voltage levels between two operation modes. These two high voltage AC signals need to be synchronized. The cMUT elements in a cMUT array cannot share the same AC bias signal for beam-forming. As a result, each cMUT element needs two separate wires in order to operate. This doubles the number of wires used in the cMUT system, and significantly increases the complexity and the cost of the system. The problem is especially acute when a CMUR array with a large number of elements is used.

In order to optimize both RX and TX performances and to simplify the system complexity, better cMUT operation methods need to be developed.

SUMMARY

A cMUT and a cMUT operation method use an input signal that has two components with different frequency characteristics. The primary frequencies of the first component are within a frequency response band of the cMUT, while the primary frequencies of the second component are out of the frequency response band of the cMUT. The first component of the input signal is used to generate the desired acoustic output for CMUT transmission (TX) operation. The bias signal and the second component of the input signal together define an operation voltage applied on the cMUT. The operation voltage is used to set an operation condition (or an operation point) for the CMUT and does not generate significant acoustic output in the frequency band of the CMUT.

The operation voltage is variable between operation modes, such as transmission and reception modes. The cMUT allows operating a cMUT with a variable operation voltage by requiring only one AC component. This allows the bias signal to be commonly shared by multiple cMUT elements, and is thus easier to implement in a CMUT system, especially for a CMUT array with large number of elements. The implementations of the cMUT and the operation method are particularly suitable for ultrasonic harmonic imaging in which the reception mode receives higher harmonic frequencies.

One aspect of the disclosure is a cMUT system that has at least one cMUT element. An input signal source is operative to apply an input signal including two components with different frequency characteristics. The bias signal and the input signal component which has out-of-band frequencies (e.g., low frequencies) together apply an operation voltage on the cMUT element. The operation voltage is different in the first operation mode (e.g., a transmission mode) than in the second operation mode (e.g., a reception mode). The bias signal may be a DC signal.

In one embodiment, the cMUT system is adapted for switchably operating in two different types of imaging. The operation voltage is different in transmission and reception in the first type imaging, but is the same for both transmission and reception in the second type imaging. The first type imaging images a sample area at a far distance from the system, and the second type imaging images a sample area close to the system.

Another aspect of the disclosure is a method for operating a cMUT. The method provides a cMUT including at least one cMUT element. The method configures the cMUT so that the input signal source is operative to apply an input signal which has two components with different frequency characteristics, and that the bias signal and the input signal component with out-of-band frequencies (e.g., low frequencies) together apply an operation voltage on the cMUT element. The operation voltage is different in different operation modes, such as transmission mode and reception mode.

Another aspect is a method for operating a cMUT by providing a cMUT and configuring the cMUT so that an operation voltage at least partially contributed by the bias voltage and/or the input signal is applied on the cMUT element in operation. The operation voltage is configured to be around zero in a transmission mode and nonzero in a reception mode. The transmission mode may be configured to perform a second-order frequency operation. In one embodiment, the operating signal is at least partially contributed by an out-of-band frequency (e.g., low frequency) component of the input signal.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE FIGURES

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION

Embodiments of the disclosed cMUT operation method use a variable operation voltage that changes from time to time when the operation mode of the cMUT changes. The operation voltage is used to set an operation condition (or an operation point) of the CMUT and does not generate any meaningful acoustic output within the frequency band of a CMUT. One feature of the present disclosure is to form an operation voltage at least partially from an AC component of the TX input signal. The AC component of the TX input signal, along with a bias signal, allows setting a variable operation voltage so that different operation voltages are used for different operation modes, such as transmission (TX) and reception (RX) modes. The method can optimize the performance of the cMUT in both transmission and reception operations at the same time. Exemplary implementations of the method are disclosed below.

Figure 1:
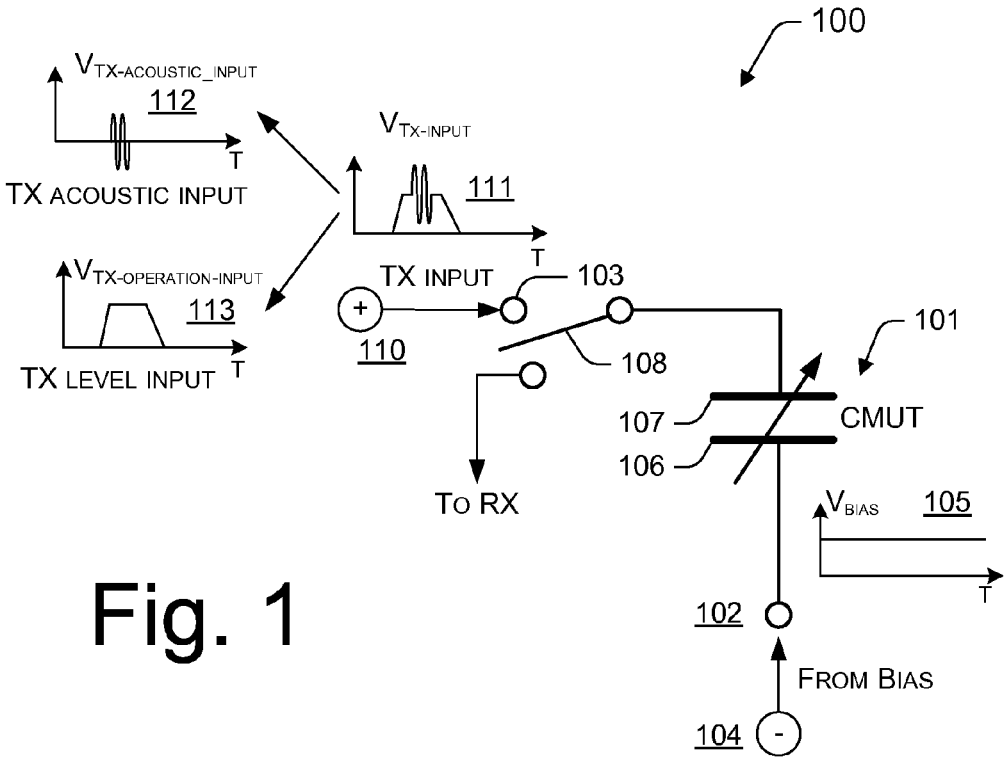
FIG. 1 illustrates a first exemplary cMUT system using a variable operation voltage.

FIG. 1 illustrates a first exemplary cMUT system using a variable operation voltage. The cMUT system 100 has a cMUT 101. The details of the cMUT are not shown as they are not essential to the present disclosure. In principle, any cMUT, including both flexible membrane cMUTs and embedded spring cMUTs (EScMUTs), may be used. A cMUT has a first electrode and a second electrode separated from each other by an electrode gap so that a capacitance exists between the electrodes. A spring member (e.g., a flexible membrane or a spring layer) supports one of the electrodes for enabling the two electrodes to move toward or away from each other. In a flexible membrane cMUTs, the spring member is a flexible membrane directly supporting one of the electrodes. In an EScMUT, the spring member is a spring layer supporting an electrode on a plate which is suspended from the spring layer by spring-plate connectors.

The cMUT 101 is connected to a bias signal port 102 and an input signal port 103. A bias signal source 104 is connected with the bias signal port 102 to apply a bias signal 105 to the cMUT 101 on the first electrode 106. An input signal source 110 is connected with the input signal port 103. The input signal source 110 is operative to apply an input signal 111 to the cMUT 101 on the second electrode 107.

The input signal 111 includes a first input signal component 112 and a second input signal component 113. The primary frequencies of the first input signal component 112 are within a frequency response band of the cMUT 101. The first input signal component 112 is referred to as the TX acoustic input signal in this disclosure. This TX acoustic input signal 112 generates acoustic energy (acoustic output) through the cMUT 101. The second input signal component 113 is an operation input signal primarily having out-of-band frequencies (e.g., low frequencies substantially below the frequency response band of the cMUT 101). This operation input signal 113 preferably does not significantly contribute to generating acoustic energy or acoustic output of the cMUT 101, and is used as at least a part of the operation voltage applied over the cMUT 101. In one embodiment, the operation input signal 113 does not generate any meaningful acoustic output of the cMUT 101. The second input signal component 113 is referred to as the TX operation input signal in this disclosure.

The second input signal component 113 and the bias signal 105 together apply an operation voltage on the cMUT 101. As will be described below, the operation voltage can be made different in different operation modes such as TX and RX modes.

In operation, the cMUT system 100 is switched between the TX at RX modes using a switch 108, which can be any suitable switch such as electronic switch or mechanical switch. The switch 108 may be replaced by a circuit which functions like a switch (e.g., a protection circuit for RX detection circuit during TX operation). The cMUT system 100 may have other components including beamforming devices, controllers, signal processors, and other electronics. These components are not shown.

Unlike the TX input signal in existing methods, the TX input signal 111 in the disclosed method is not only used to generate the ultrasound output, it is also used to set the operation voltage level together with a bias signal. In other words, the TX input signal 111 includes two signal components: one is a TX acoustic input signal 112 used to generate a desired acoustic output signal, and the other is a TX operation input signal 113 used to change the operation voltage level. The TX acoustic input signal 112 may be any input signal suitable for generating an acoustic output, such as that used in the conventional cMUT operation methods.

In the frequency domain, the spectrum of TX acoustic input signal 112 is preferably within the bandwidth of the frequency response of the cMUT 101. The spectrum of the TX operation input signal 113 is preferably outside of the bandwidth of the acoustic output of the cMUT 101. Therefore, the frequency of TX operation input signal 113 is preferably either much higher or much lower than that of the TX acoustic input signal 112. In one preferred embodiment, the TX operation input signal 113 has primarily frequencies that are substantially below of the bandwidth of the acoustic output of the cMUT 101.

In one embodiment, the bias signal 105 is a DC voltage signal which has the same voltage level for both TX and RX operations of the cMUT 101. So the operation voltage level difference between TX and RX operations of the cMUT 101 is determined by the TX input signal 111 only.

In another embodiment, the bias signal 105 is continuous modulation signal with a frequency significantly higher than the cMUT operating frequency (e.g., beyond the bandwidth of the frequency response of the cMUT 101). So the bias signal 105 has the same voltage level for both TX and RX operations of the cMUT 101. Thus the operation voltage level difference between TX and RX operations of the cMUT 101 in this embodiment is also defined by the TX input signal 111 only.

Compared with the existing cMUT operation methods which have the same operation voltage level for both TX and RX operations, the disclosed method potentially improves the cMUT performance because it offers an opportunity to optimize the operation voltage levels of both TX and RX operation at the same time, instead of settling down with a compromise.

Furthermore, the disclosed cMUT operation method requires only one AC signal, namely the TX input signal 111. The bias signal 105 may either be a DC voltage or a high frequency modulation signal. There is no need to synchronize between the bias signal 105 and TX input signal 111. Thus the disclosed method is potentially much easier to be implemented than those methods which use two AC signals (an AC bias signal in addition to an AC input signal) which need to be synchronized and carried by two cables for each cMUT element.

If an AC bias signal is used in synchronization with the AC TX input signal, the elements of a cMUT array cannot share the same AC bias signal, and as a result each cMUT element needs two dedicated cables to access two AC signals. This could result in high costs of the system, especially when a cMUT array with a large number of elements is used. The disclosed method, however, makes it possible to use either a DC bias signal or a high frequency modulation bias signal which can be shared by some or all elements in a cMUT array. In this preferred embodiment, each cMUT element therefore needs only one dedicated cable in order to be individually signaled or addressed.

Figure 1A:
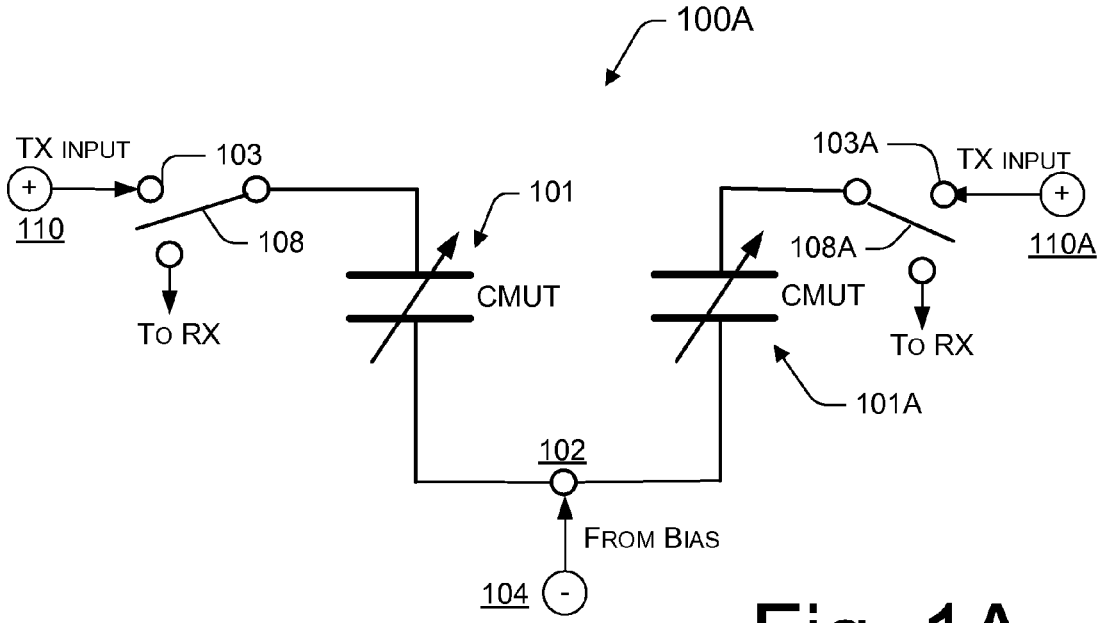
FIG. 1A illustrates another aspect of the first exemplary cMUT system using a variable operation voltage.

FIG. 1A illustrates another aspect of the first exemplary cMUT system using a variable operation voltage. The cMUT system 100A is based on the same principles used in the cMUT system 100 described with reference to FIG. 1, but shows two cMUTs 101 and 101A, each configured in a similar manner as the cMUT 101 of FIG. 1.

Like cMUT 101, cMUT 101A is connected to the common bias signal port 102 and an input signal port 103A. The common bias signal source 104 is connected with the common bias signal port 102 to apply the same bias signal to the cMUT 101A. An input signal source 110A is connected with the input signal port 103A, and is operative to apply an input signal to the cMUT 101A. The input signal sources 110 and 110A may either be separate signal sources or the same signal source which is capable to deliver multiple separate input signals to separate cMUTs.

As shown in FIG. 1, the two cMUTs 101 and 101A share the common bias signal and therefore do not require individual wiring. Instead, a side of both cMUTs 101 and 101A may be made in contact with a common conductor in fabrication without individual wiring. The input signals, on the other hand, are individually addressed to each cMUT 101 and 101A, and therefore need individual wiring. Specifically, different input signals may be applied to different cMUT elements. The difference of the input signals may be either in the TX acoustic input signal 112 or in the TX operation input signal 113, or both. When the TX operation input signal 113 is different in different cMUT elements (101 and 101A), the cMUT elements have different operation voltages and may be operated under different conditions.

The two cMUTs 101 and 101A are only illustrative. These cMUTs may each represent an individually addressed cMUT element, a cMUT cell or cMUT unit having multiple cMUT elements, or sub-elements of the same cMUT element. It is appreciated that any number of cMUT elements similar to cMUTs 101 and 101A may be connected and used in the same cMUT array.

The input signal applied to each cMUT 101 and 101A may include a TX acoustic input signal and a TX operation input signal, similar to the input signal 111 of the cMUT 101 in FIG. 1. The input signals for cMUTs 101 and 101A, however, may be individualized and different in their signal levels, timing, phase and frequencies.

In operation, each cMUT 101 or 101A is switched between the TX at RX modes using its respective switch (108 or 108A). The cMUT system 100 may have other components including beamforming devices, controllers, signal processors, and other electronics.

Figure 2:
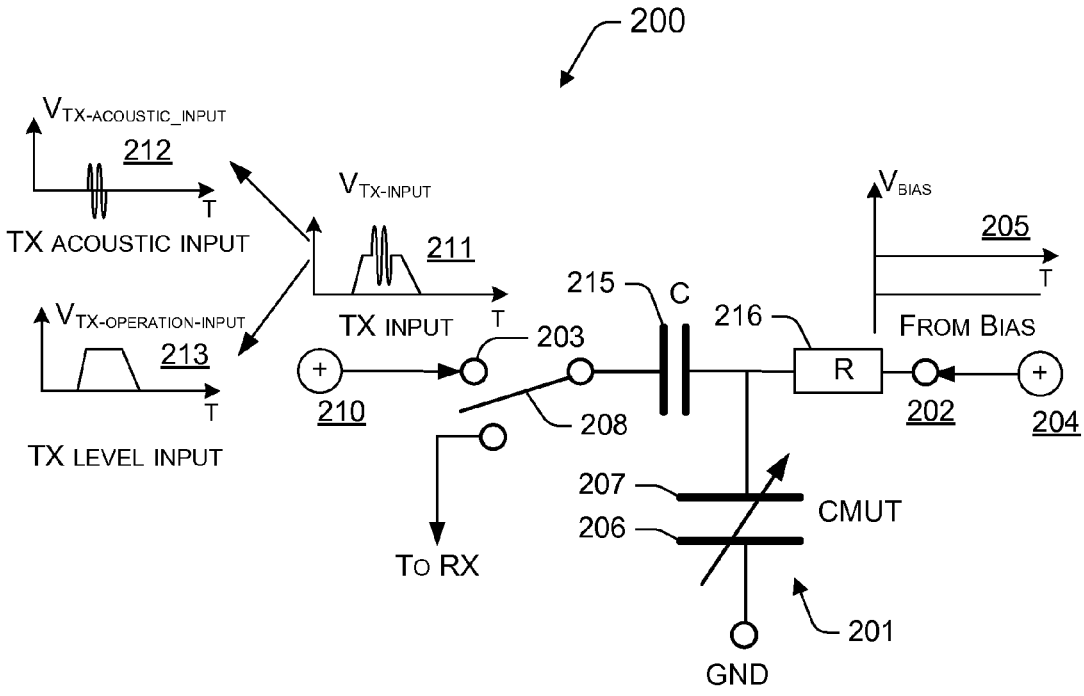
FIG. 2 illustrates a second exemplary cMUT system using a variable operation voltage.

FIG. 2 illustrates a second exemplary cMUT system using a variable operation voltage. The details of the cMUTs 201 are not shown. In principle, any cMUT, including both flexible membrane cMUTs and embedded spring cMUTs (ESc-MUTs), may be used. The cMUT system 200 is based on similar principles used in the cMUT system 100 described with reference to FIG. 1 to form a variable operation voltage for different operation modes (e.g., TX and RX). For example, the TX input signal 211 has a first component TX acoustic input signal 212 and a second component TX operation input signal 213. The TX input signal 211 is supplied by a signal source 210, and applied at the cMUT 201 through the TX port 203 and the switch 208.

However, the cMUT system 200 is different from the cMUT system 100 in several aspects. The bias signal 205 and the TX input signal 211 are applied on the same electrode 207 of the cMUT 201, while the bias signal 105 and the TX input signal 111 are applied on the opposite electrodes 106 and 107 of the cMUT 101 in FIG. 1. The other electrode 206 of the CMUT 201 is connected to GND. The TX input signal 211 is provided by the signal source 210 through a TX port 203. The bias signal 205 is provided by a signal source 204 through a bias port 202. As a result, the operation voltage level applied on the cMUT 201 is the sum of the TX operation input signal 213 and the bias signal 205 in this implementation. In comparison, the operation voltage level applied on the cMUT 101 is the subtraction of the TX operation input signal 113 and the bias signal 105 in the implementation in FIG. 1. Noticeably, the bias signal 205 in FIG. 2 is negative, while the bias signal 105 is positive in FIG. 1, so that the resultant variable operation voltage levels in both cMUT 100 and the cMUT 200 are the same. Furthermore, cMUT 200 has a bias circuit including a decouple capacitor C 215 and a bias resistor R 216, to accommodate the design in the cMUT system 200

Figure 3A:
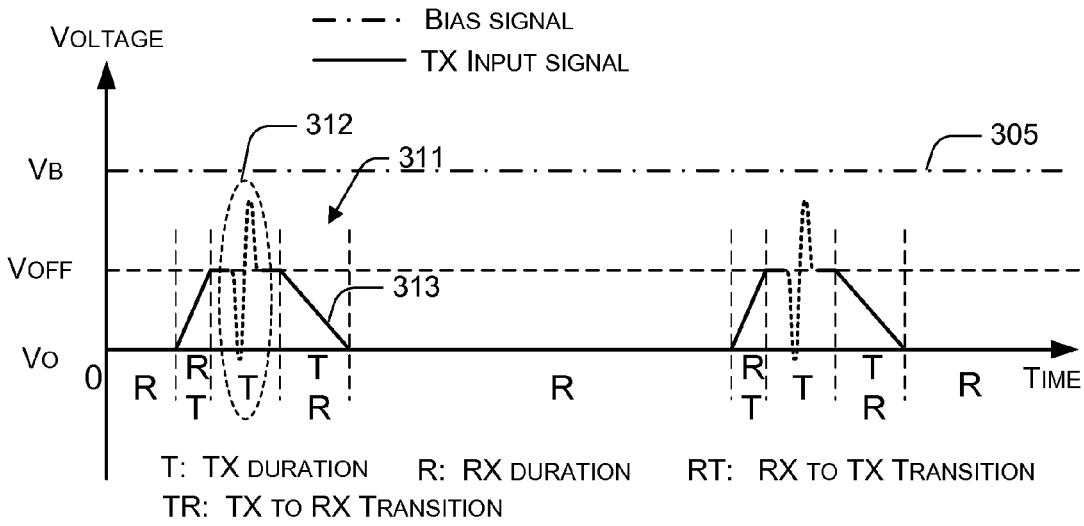
FIGS. 3A-3E illustrate a first example of a bias signal and a TX input signal, and the corresponding operation voltage.

FIGS. 3A-3E illustrate a first example of a bias signal and a TX input signal, and the corresponding operation voltage according to the first exemplary embodiment of the cMUT system of FIG. 1. FIG. 3A shows the bias signal 305 and the TX input signal 311. The signals are each represented by a voltage/time graph. Including the transition periods, the signals may include four periods or durations: TX duration, RX duration, RX to TX transition, and TX to RX transition. These durations are denoted as "T", "R", "RT", and "TR", respectively, in FIG. 3A and subsequent figures. Sometimes, one or two transition regions may merge with either RX or TX duration.

The bias signal 305 is a DC bias signal ($V_B$). The TX input signal 311 comprises two signal components: TX acoustic input signal 312 and TX operation input signal 313. The TX input signal 311 can be formed by combining from two separately generated signals TX acoustic input signal 312 and TX operation input signal 313. However, the TX input signal 311 can also be generated directly using a proper signal generator.

The TX operation input signal 313 in TX input signal 311 should usually be present in at least TX duration (T) and RX duration (R). The cMUT performs as an ultrasound transmitter during the TX duration and an ultrasound receiver during the RX duration. The operation voltage levels in RX and TX durations may be set differently. The TX operation input signal 313 in TX input signal 311 is preferably set to be zero at RX duration. The TX acoustic input signal 312 in TX input signal 311, on the other hand, should usually be present within TX duration, but preferably in no other regions.

The TX operation input signal 313 in TX input signal 311 may be present at the RX to TX transition (RT) and TX to RX transition (TR) as well. Sometimes, one or two transition regions may merge with either RX or TX duration.

Figure 3B:
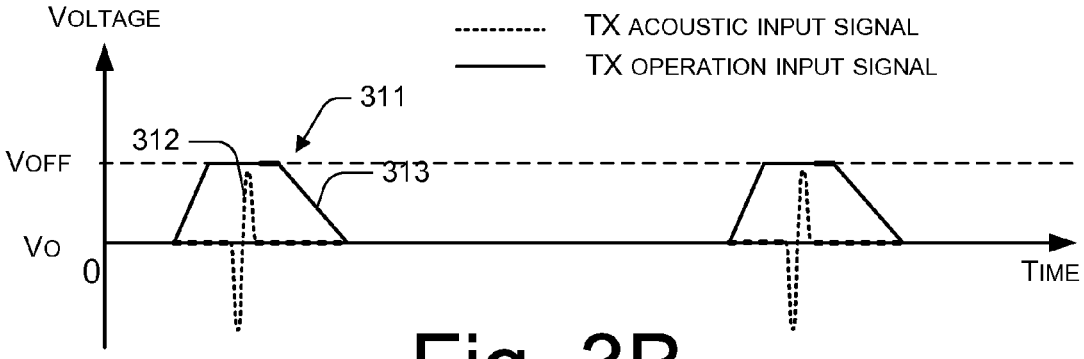

FIG. 3B illustrates the TX acoustic input signal 312 and the TX operation input signal 313 in the TX input signal 311 of FIG. 3A. These two input signals are two components of the TX input signal 311 of FIG. 3A. The TX input signal 311 may have multiple voltage levels in its duration. The exemplary TX input signal 311 has two different voltage levels, $V_{OFF}$ and $V_O$, for transmission and reception operations, respectively. $V_O$ is usually set to be zero. The TX acoustic input signal 312 is primarily present in TX duration (T).

Figure 3C:
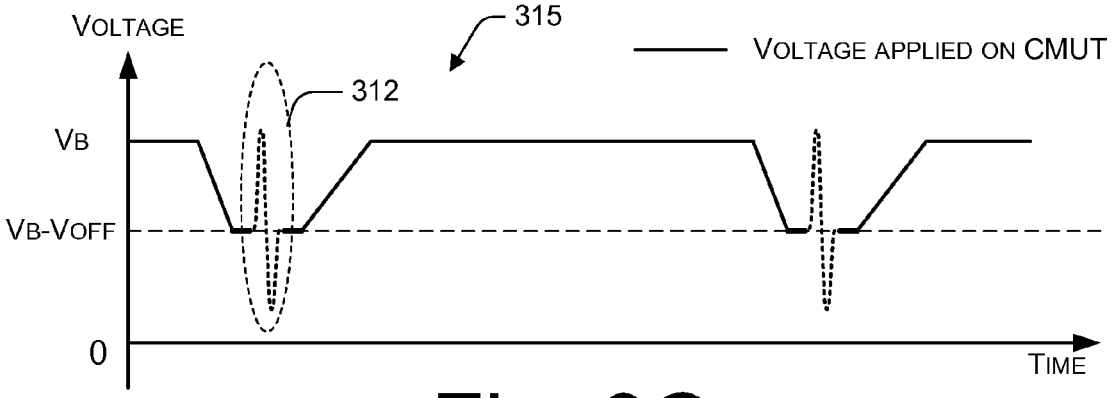

FIG. 3C illustrates the overall voltage applied on the cMUT, which is either the subtraction or sum of the TX input signal 311 and the bias signal 305, depending on the signal polarity and the implementation of the method used in the cMUT system. In the example illustrated, the overall voltage 315 applied on the cMUT is the subtraction of the TX input signal 311 and the bias signal 305. The overall voltage 315 has two significant operation voltage levels. The first level $V_B$ has higher absolute voltage and is for reception (RX) operation, and the second level $V_B-V_{OFF}$ with lower absolute voltage is for the transmission (TX) operation. In the transmission operation, the TX acoustic input signal 312 is present to generate acoustic energy. The other portion of the overall voltage 315 is for establishing a proper operating condition of the cMUT. The voltages of the bias signal 305 and the TX input signal 311 can be purposely selected to achieve a desired performance of the cMUT.

Figure 3D:
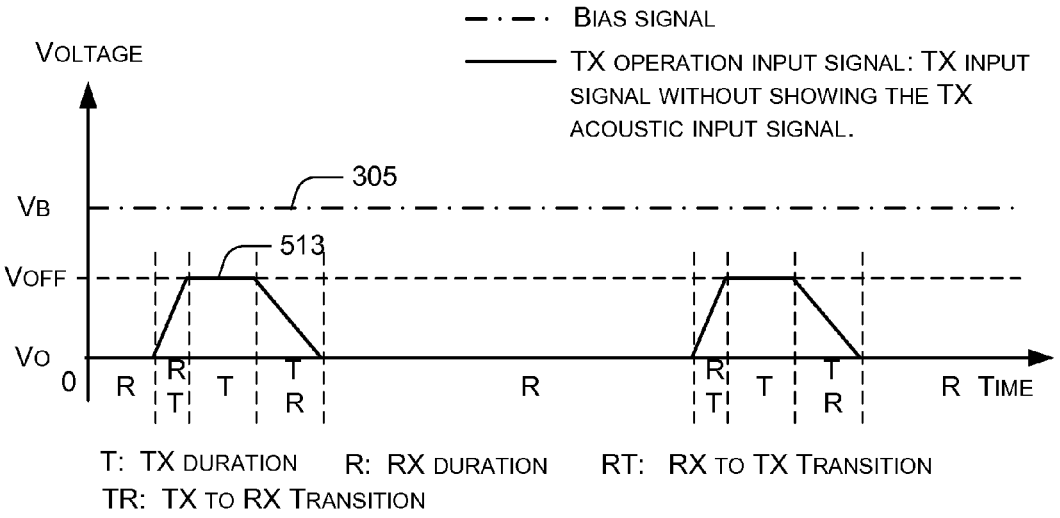

FIG. 3D illustrates the bias signal 305 and the TX operation input signal 313 without showing the TX acoustic input signal 312 in the TX input signal 311.

Figure 3E:
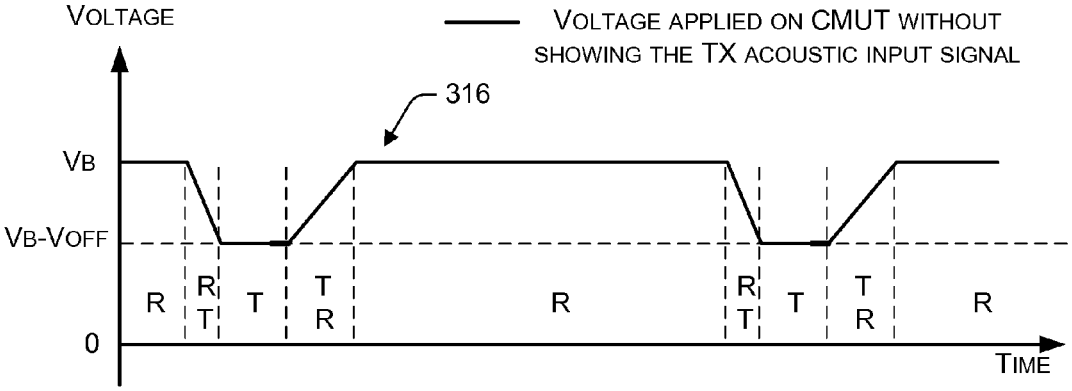

FIG. 3E illustrates the overall operation voltage 316 applied on the cMUT without showing the TX acoustic input signal 312 in the TX input signal 311. FIGS. 3D and 3E are used to more clearly illustrate how the TX operation input signal 313 is used, along with the bias signal 305, to change the operation voltage level 316.

Figure 4A:
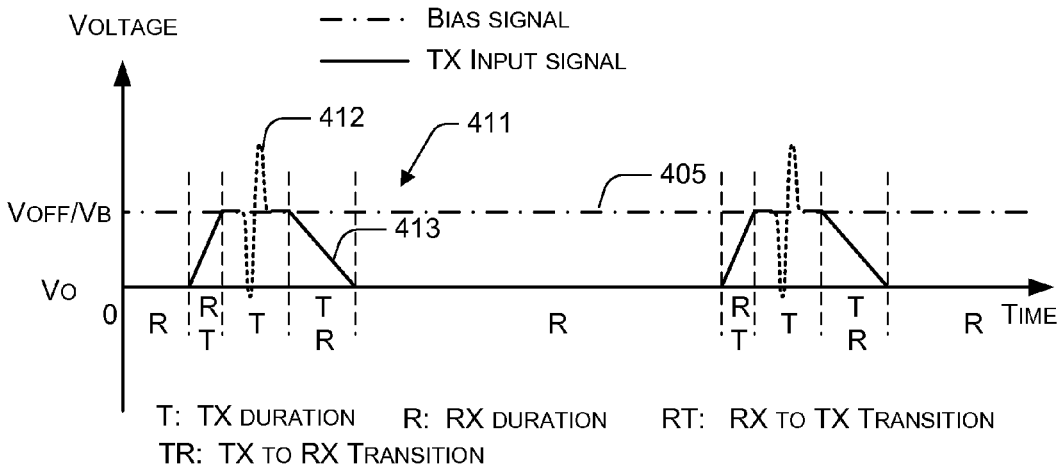
FIGS. 4A and 4B illustrate a second example of a bias signal and a TX input signal, and the corresponding operation voltage.
Figure 4B:
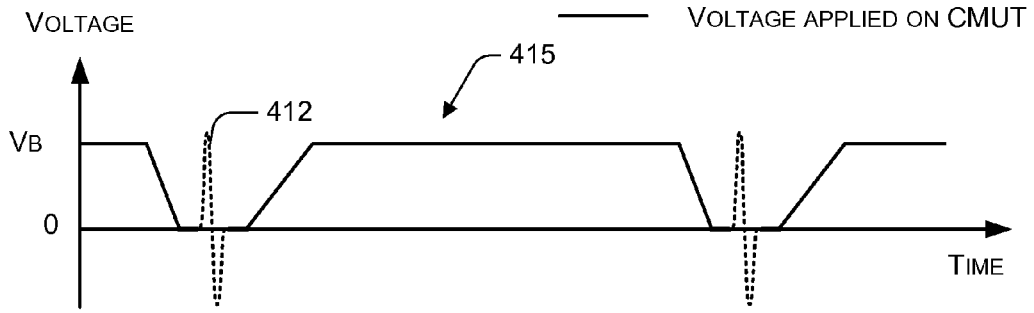

FIGS. 4A and 4B illustrate a second example of a bias signal and a TX input signal, and the corresponding operation voltage. The signals in the second example are similar to that in the first example shown in FIGS. 3A-3E, except for the different voltage level settings. Similarly, the bias signal 305 is a DC bias signal ($V_B$). The TX input signal 411 comprises two signal components: TX acoustic input signal 412 and TX operation input signal 413. In this embodiment, the bias voltage ($V_B$) of the bias signal 405 is set to be the same as the voltage level $V_{OFF}$ of the TX operation input signal 413 in the TX input signal 411 so that these two voltages cancel out during transmission. As a result, the operation voltage level in the overall voltage 415 applied on the cMUT at transmission is zero or close to zero.

This second exemplary embodiment is suited for a special cMUT operation technique called second-order frequency method disclosed in the U.S. patent application Ser. No. 11/965,919, entitled "SIGNAL CONTROL IN MICROMACHINED ULTRASONIC TRANSDUCER", which application is hereby incorporated by reference in its entirety. In a second-order frequency operation, the acoustic output signal is proportional to the square of TX acoustic input signal 412, and is suited for generating a desired acoustic output without harmonic components. This may be critical for a cMUT to perform harmonic imaging.

One exemplary second-order frequency method sets a special TX acoustic signal, e.g. $V_{TX} \propto \sin(\omega t/\mathbf{2})$, of a cMUT which has a base frequency at $\omega/\mathbf{2}$ and generate an acoustic output which has a dominating second-order frequency component at an output signal frequency of $\omega$ without any higher frequency harmonics. The base frequency $\omega/\mathbf{2}$ may be chosen to be about half of a desired operating frequency $\omega\mathbf{0}$ of the cMUT, such that the output signal frequency $\mathbf{2}\omega$ is close to the desired operating frequency $\omega\mathbf{0}$. The operating frequency $\omega\mathbf{0}$ is usually in the frequency band of the frequency response of the cMUT, and may preferably be close to the center frequency of the band. More examples are disclosed in the incorporated U.S. patent application Ser. No. 11/965,919.

The second-order frequency method is used herein in a cMUT system that switches between two operation modes. Specifically, in one embodiment, the cMUT system switches to a second-order frequency operation method for transmission, but returns to a different operation method for reception. The operation voltage level applied on the cMUT varies accordingly as the operation mode changes. An operation voltage at or close to zero is particularly suited for the second-order frequency operation mode.

It is noted that any methods suited for providing a variable operation voltage to a cMUT may be used for the above-described implementations of the second-order frequency techniques.

The TX acoustic input signal (e.g., 312 or 412) is used to generate the desired acoustic output. Any suitable AC signal or waveform may be used. This signal may be any electrical signal to generate the desired acoustic output, e.g. a single sine pulse, multiple sine pulses, a Gaussian-shape pulse, a half-cosine pulse and a square pulse, etc. The TX acoustic signal is defined by the requirement of the imaging systems.

Figure 5:
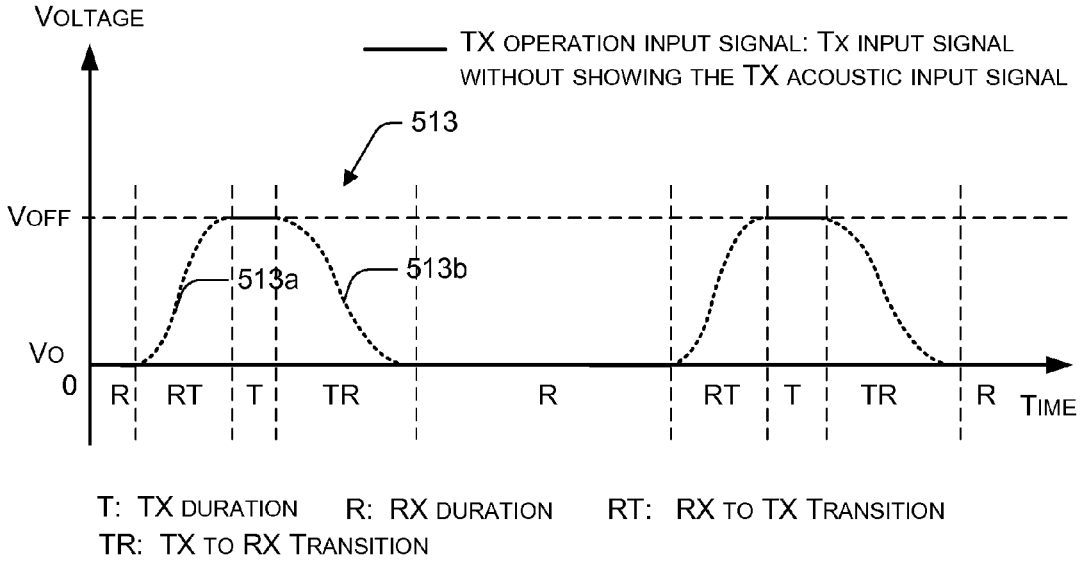
FIG. 5 illustrates a third example of the TX operation input signal.

FIG. 5 shows a third example of the TX operation input signal. The TX operation input signal 513 is similar to that shown in FIGS. 3-4, and is designed to further minimize the frequency components of the TX operation input signal 513 in the operating frequency region (bandwidth) of the cMUT so that the TX operation input signal 513 does not contribute a significant amount of ultrasound output during cMUT operation. This is done by rounding the corners of the TX operation input signal 515.

The higher frequency components in the TX operation input signal 513 originate from the transition regions where the signal voltage level changes. The shapes and widths of the TX operation input signal 513 (313, 413) in the transition regions (513*a* and 513*b*) are therefore preferably designed so that the signal may not generate output acoustic signals to interfere with TX acoustic input signal during these transition regions, such as RX to TX (RT) and TX to RX (TR) transition regions. Usually, this may be done by controlling of the frequency components of TX operation input signal 513 (313, 413) to keep them out of the bandwidth of the cMUT so that the TX operation input signal 513 (313, 413) generates minimum ultrasound output by the cMUT. As illustrated, the sharp corners of the TX operation input signal 513 (313, 413) are rounded. The signals 513*a* and 513*b* in transition durations in FIG. 5 are just examples. Any other signal shapes designed to minimize the generation of the ultrasound in the interested frequency band of the cMUT may be used.

The TX operation input signal 513, or any other TX operation input signal aiming to minimize its frequency components in the operating frequency range of the cMUT, may be generated and then filtered using a proper low-pass or band-pass filter with a high cut-off frequency lower than the operating frequency region of the cMUT, then combined with TX acoustic input signal (e.g., 312, 412) to make the total TX input signal (e.g., 311, 411).

FIGS. 6A-6D illustrate a fourth example of a bias signal and a TX input signal, and the corresponding operation voltage. In this embodiment, the TX duration (T) of the TX input signal 611 is designed to be the same as the length (time) of the TX acoustic input signal 612. The TX acoustic input signal 612 and the TX duration (T) of TX operation input signal 613 are synchronized to have the same starting time and/or the same ending time. In this embodiment, one or both of transition regions (RT and TR) of the TX operation input signal 613 may be treated as a part of the TX acoustic input signal 612. These transition regions correspond to the rising or falling slopes of the TX operation input signal 613. This results in an integrated TX acoustic input signal which includes both the original TX acoustic input signal 612 and the transition region portions of the TX operation input signal 613. This may minimize artifacts in the imaging caused by undesired acoustic signal generated by the TX operation input signal 613.

Figure 6A:
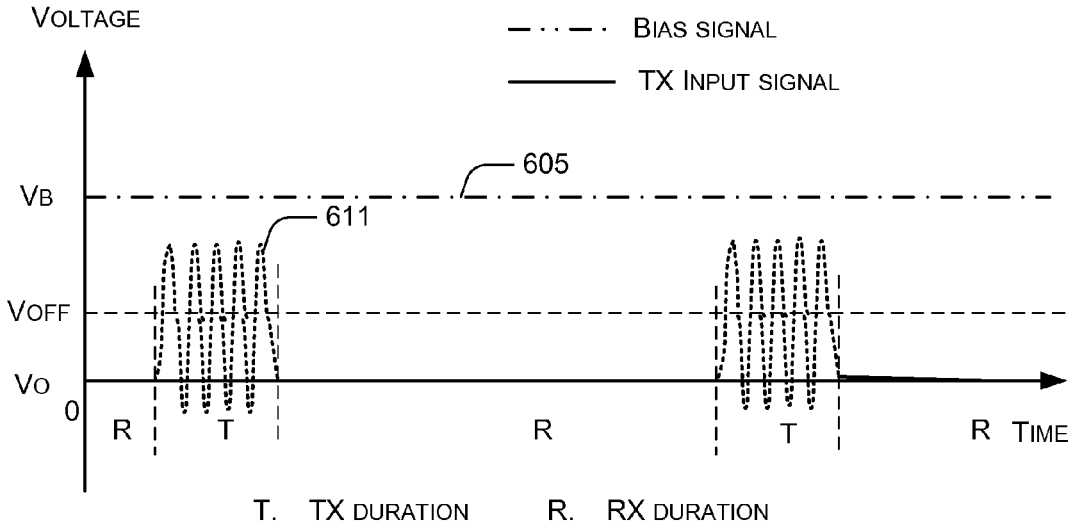
FIGS. 6A-6D illustrate a fourth example of a bias signal and a TX input signal, and the corresponding operation voltage.
Figure 6B:
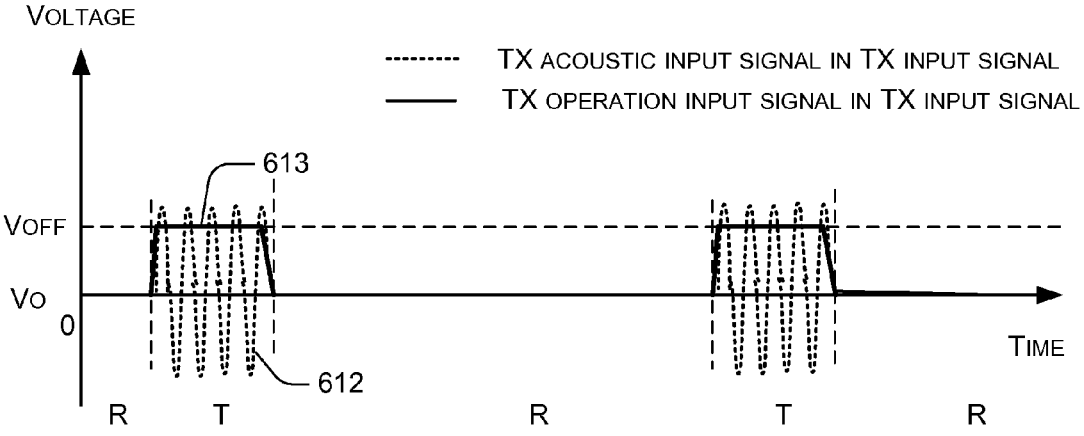
Figure 6C:
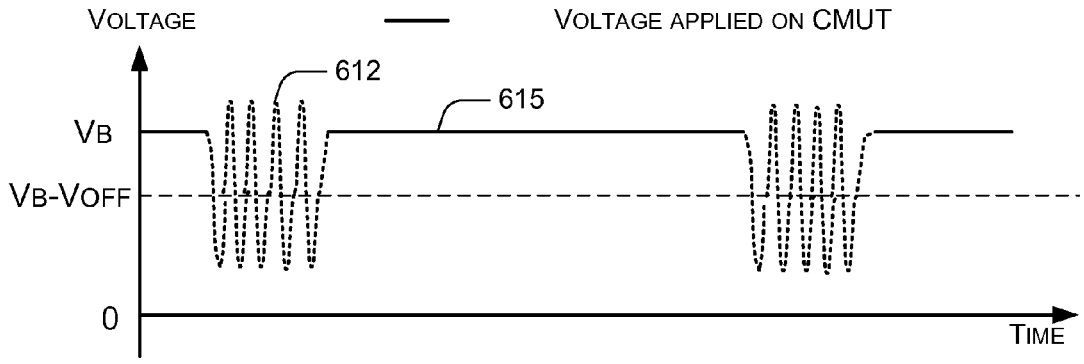
Figure 6D:
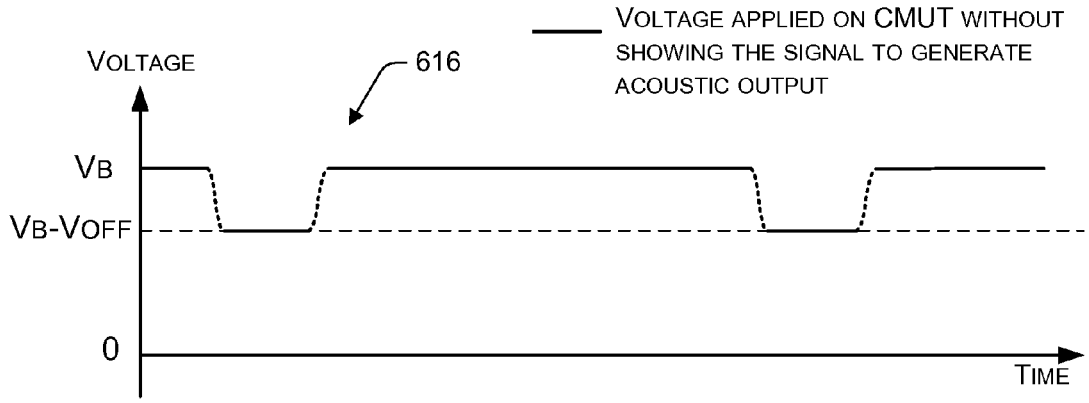

FIG. 6A shows the bias signal 605 and the TX input signal 611. FIG. 6B shows the TX acoustic input signal 612 and the TX operation input signal 613, which are timed to coincide with each other in transitions. FIG. 6C illustrates the resultant overall voltage 615 applied on the cMUT showing the TX acoustic input signal 612. FIG. 6D shows the operation voltage 616 in the overall voltage 615 without showing the TX acoustic input signal 612. This illustrates how the voltage level varies in different operation modes (TX and RX).

The TX input signal (e.g., 111) of the present disclosure may be provided by any suitable signal source, e.g. an arbitrary signal generator. It may be first generated at low voltage level, and then amplified to the desired voltage level. The TX input signal may also be synthesized by combining (e.g., by superposing) a TX acoustic signal and a TX operation signal which are separately generated. In this case, the TX operation signal can be filtered using a lower pass or band-pass filter before superposition. The superposed TX input signal may be then amplified to the desired level if needed before it is applied on the CMUT with a bias signal.

The disclosed cMUT operation method may also benefit apodization for a cMUT array. In the existing methods, the apodization is done by applying a desired bias signal on each cMUT element. Regardless of which kind of bias signal is used, each cMUT element in the array needs a separated bias signal line in order to have an individualized or differentiated operation voltage level. As a result, each element needs two separated signal lines, namely a bias line and a signal line. This makes the transducer interconnections much more complex. Using the disclosed method, both the acoustic output and the operation voltage level of each element may be determined by the TX input signal applied to the element only. Therefore, any signal individualization (e.g., addressing) and differentiation (e.g., apodization) may be accomplished using the TX input signal. This makes it possible for some or all elements in the array to share the same bias line. Furthermore, the method in present disclosure requires only one high voltage/power signal and does not require synchronization of multiple AC signals from different AC sources. This also makes the implementation of certain operation techniques such as apodization much easier than the existing methods.

The disclosed method aims to improve the cMUT performance by optimizing both TX and RX operations. One of the most important goals of the cMUT performance optimization is to increase the close-loop sensitivity of the device so that it can penetrate deeper into the medium to increase the imagine region. However, increasing sensitivity may come at a price of increasing the dead zone of the system if the speed of switching between a TX voltage level and a RX voltage level needs to be slow in order to minimize the contribution of TX operation input signal to the acoustic output in the frequency band of the cMUT. The dead zone is determined by delay time for the system to become ready to detection after the end of TX acoustic signal.

To overcome this problem, the present disclosure proposes a dual-imaging cMUT method and system. The method provides a cMUT and adapts the cMUT for operating in a first type imaging and a second type imaging, so that the operation voltage is different in transmission than in reception in the first type imaging but is the same in transmission and in reception in the second type imaging. In one embodiment, the first type imaging images a sample area at a far distance from the cMUT, and the second type imaging images a sample area close to the cMUT. For far distance imaging, an operating method providing a variable operation voltage (such as the method disclosed herein) may be used to increase the sensitivity. For proximity imaging, a conventional method (or any other method that minimizes the dead zone) may be used to operate the cMUT. Doing this does not affect the imaging quality because the requirement of close-loop sensitivity is much lower at the imaging region close to the cMUT. In operation, the cMUT system switches between the two imaging modes depending on the imaging needs. It is noted that each imaging mode may include both transmission and reception modes.

Alternatively, two separate cMUTs (either separate cMUT elements or separate cMUT arrays) may be used in the cMUT system for the above procedure. The first cMUT is adapted for operation using a variable operation voltage method, and the second cMUT is adapted for operation using a conventional operation voltage method (or any other method that minimizes dead zone).

It is noted that in addition to the methods for variable operation voltage disclosed herein, any methods suited for providing a variable operation voltage to a cMUT may be used for the above-described implementations of dual-imaging or multi-imaging techniques.

One of the exemplary applications of the disclosed cMUTs and operation methods is the popular ultrasound harmonic imaging. In ultrasonic harmonic imaging, usually the transducer generates a desired acoustic output and emits it into a medium in TX operation and receives an echo signal from the medium in RX operation. A part of the received signal centers around a center frequency of the TX output (referred to as the fundamental frequencies of the system) and another part of the received signal centers around the harmonic frequency region of the TX output (referred to as the harmonic frequencies of the system). Usually, both the fundamental frequencies and the harmonic frequencies of the system are within the frequency band of the CMUT. In regular cMUT operation, the fundamental frequencies usually occupy a half band at the lower frequency side while the harmonic frequencies usually occupy the other half band at the higher frequency side. The harmonic imaging method usually uses the harmonic part of the received signal to improve the imaging resolution. This is because the harmonic signal is at a higher frequency, where the acoustic wavelength is shorter, which enables better axial resolution.

The existing harmonic imaging techniques used the same transducer or transducer array having a single operation condition for both TX and RX operation. In these techniques, the frequency response of the transducer in the TX and RX operations are almost identical. Using the method described herein, the variable operation voltage may be used to switch the cMUT between two different operating conditions which have different acoustic properties. Examples of suitable dual-operating condition cMUTs or dual-mode cMUTs and the corresponding switching methods are disclosed in International (PCT) Patent Application No. 12/745,737, entitled "DUAL-MODE OPERATION MICROMACHINED ULTRASONIC TRANSDUCER", filed on even date with the present application. The referenced PCT patent application is hereby incorporated by reference in its entirety.

It is noted that although the method is illustrated using micromachined ultrasonic transducers, especially capacitance micromachined ultrasonic transducers (cMUTs), the operation method disclosed herein can be applied to any electrostatic transducers which operate with an operation voltage at multiple operation modes, such as transmission and reception modes.

It is appreciated that the potential benefits and advantages discussed herein are not to be construed as a limitation or restriction to the scope of the appended claims.

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A capacitive micromachined ultrasonic transducer (cMUT) system, the system comprising:

a bias signal port;

an input signal port;

at least a first cMUT element connected to the bias signal port and the input signal port;

a bias signal source connected with the bias signal port to apply a bias signal to the first cMUT element; and an input signal source connected with the input signal port, the input signal source being operative to apply an input signal to the first cMUT element, the input signal including a first input signal component and a second input signal component, the first input signal component having primarily acoustic frequencies within a frequency response band of the first cMUT element, and the second input signal component having primarily frequencies substantially out of the frequency response band of the first cMUT element, and wherein the second input signal component and the bias signal together define an operation voltage applied on the first cMUT element, the operation voltage being different in a first operation mode than in a second operation mode.

2. The system as recited in claim 1, wherein the bias signal is a DC signal.

3. The system as recited in claim 1, wherein the first operation mode is a transmission (TX) mode, and the second operation mode is a reception (RX) mode.

4. The system as recited in claim 1, wherein the first operation mode operates at a first frequency range and the second operation mode operates at a second frequency range substantially different from the first frequency range.

5. The system as recited in claim 1, wherein the first cMUT element is operative to perform harmonic imaging, the first operation mode operating at fundamental frequencies of the system, and the second operation mode operating at the harmonic frequencies of the system.

6. The system as recited in claim 1, wherein the operation voltage is around zero in the first operation mode.

7. The system as recited in claim 6, wherein the first operation mode is a transmission (TX) mode.

8. The system as recited in claim 6, wherein the first operation mode comprises a second-order frequency operation.

9. The system as recited in claim 1, wherein the first input signal component in the first operation mode has a waveform at a base frequency $\omega/2$, the waveform generating through the first cMUT element an output signal which has a dominating second-order frequency component at an output signal frequency $\omega$.

10. The system as recited in claim 9, wherein the base frequency $\omega/2$ is about half of a desired operating frequency $\omega 0$ of the first cMUT element, such that the output signal frequency $\omega$ is close to the desired operating frequency $\omega 0$.

11. The system as recited in claim 9, wherein the first operation mode is a transmission (TX) mode and the operation voltage is around zero in the first operation mode.

12. The system as recited in claim 1, the system being operative to switch between a first type imaging and a second type imaging, wherein the operation voltage is different in the first operation mode than in the second operation mode in the first type imaging, and the operation voltage is the same for the first operation mode and the second operation mode in the second type imaging.

13. The system as recited in claim 12, wherein the first type imaging comprises imaging a first sample area at a far distance from the system, and the second type imaging comprises imaging a second sample area close to the system.

14. The system as recited in claim 1, further comprising a second cMUT element having a second operation voltage unchanged from transmission and reception, wherein the system is adapted for operating in a first type imaging and a second type imaging, the first type imaging using the first cMUT element, and the second type imaging using the second cMUT element.

15. The system as recited in claim 1, further comprising:

a second cMUT element connected to the said bias signal port, so that the first cMUT element and the second cMUT element share the said bias signal port and the said bias signal.

16. The system as recited in claim 1, further comprising:

a second cMUT element, wherein a second input signal is applied to the second cMUT element, the second input signal being different than the first input signal applied to the first cMUT element.

17. A method for operating a capacitive micromachined ultrasonic transducer (cMUT), the method comprising:

providing a capacitive micromachined ultrasonic transducer (cMUT) including a bias signal port, an input signal port, at least a cMUT element connected to the bias signal port and the input signal port, a bias signal source connected with the bias signal port to apply a bias signal to the cMUT element, and an input signal source connected with the input signal port, the input signal source being operative to apply an input signal to the first cMUT element; and configuring the cMUT so that the input signal includes a first input signal component and a second input signal component, the first input signal component having primarily acoustic frequencies within a frequency response band of the cMUT element, and the second input signal component having primarily frequencies substantially out of the frequency response band of the cMUT element, and that the second input signal component and the bias signal together define an operation voltage applied on the cMUT element, the operation voltage being different in a first operation mode than in a second operation mode.

18. The method as recited in claim 17, wherein the first operation mode is a transmission (TX) mode, and the second operation mode is a reception (RX) mode.

19. The method as recited in claim 17, wherein the first operation mode operates at fundamental frequencies of the system, and the second operation mode operates at the harmonic frequencies of the system.

20. The method as recited in claim 17, wherein configuring the cMUT comprises setting the operation voltage around zero in the first operation mode.

21. The method as recited in claim 20, wherein the first operation mode is a transmission (TX) mode comprising a second-order frequency operation.

22. The method as recited in claim 17, wherein configuring the cMUT comprises adapting the cMUT for operating in a first type imaging and a second type imaging, wherein the operation voltage is set to be different in the first operation mode than in the second operation mode in the first type imaging, and set to be the same for the first operation mode and the second operation mode in the second type imaging.

23. The method as recited in claim 22, wherein the first type imaging comprises imaging a first sample area at a far distance from the system, and the second type imaging comprises imaging a second sample area close to the system.

24. The method as recited in claim 17, wherein the first input signal component and the second input signal component have a same starting time and/or a same ending time in the first operation mode, such that at least one transition region of the second input signal component can be treated as a part of the first input signal component.

25. A method for operating a capacitive micromachined ultrasonic transducer (cMUT), the method comprising:

providing a capacitive micromachined ultrasonic transducer (cMUT) including a bias signal port, an input signal port, at least a cMUT element connected to the bias signal port and the input signal port, a bias signal source connected with the bias signal port to apply a bias signal to the cMUT element, and an input signal source connected with the input signal port, the input signal source being operative to apply an input signal to the cMUT element; and configuring the cMUT so that an operation voltage is applied on the cMUT element in operation, the operation voltage being at least partially contributed by the bias voltage and/or the input signal, and the operation voltage being around zero in a transmission mode and nonzero in a reception mode.

26. The method as recited in claim 25, wherein the input signal includes a first input signal component and a second input signal component, the first input signal component having primarily acoustic frequencies within a frequency response band of the cMUT element, and the second input signal component having primarily frequencies substantially out of the frequency response band of the cMUT element, and wherein the operation voltage is at least partially contributed by the second input signal component.

27. The method as recited in claim 25, wherein the transmission mode comprises a second-order frequency operation.

28. A method for operating a capacitive micromachined ultrasonic transducer (cMUT), the method comprising:

providing a capacitive micromachined ultrasonic transducer (cMUT) including a bias signal port, an input signal port, at least a cMUT element connected to the bias signal port and the input signal port, a bias signal source connected with the bias signal port to apply a bias signal to the cMUT element, and an input signal source connected with the input signal port, the input signal source being operative to apply an input signal to the cMUT element, so that an operation voltage at least partially contributed by the bias voltage and/or the input signal is applied on the cMUT element in operation; and adapting the cMUT for switchably operating in a first type imaging and a second type imaging, so that the operation voltage is different in transmission than in reception in the first type imaging but is the same in transmission and in reception in the second type imaging.

29. The method as recited in claim 28, wherein the first type imaging comprises imaging a first sample area at a far distance from the cMUT, and the second type imaging comprises imaging a second sample area close to the cMUT.

30. The method as recited in claim 28, wherein the input signal includes a first input signal component and a second input signal component, the first input signal component having primarily acoustic frequencies within a frequency response band of the cMUT element, and the second input signal component having primarily frequencies substantially out of the frequency response band of the cMUT element, and wherein the operation voltage is at least partially contributed by the second input signal component.

* * * * *